US009436134B2

(12) United States Patent
Okamoto et al.

(10) Patent No.: US 9,436,134 B2
(45) Date of Patent: Sep. 6, 2016

(54) IMAGE FORMING APPARATUS

(71) Applicant: KYOCERA Document Solutions Inc., Osaka (JP)

(72) Inventors: Sueaki Okamoto, Osaka (JP); Sadanori Nakae, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/870,587

(22) Filed: Sep. 30, 2015

(65) Prior Publication Data

US 2016/0091833 A1 Mar. 31, 2016

(30) Foreign Application Priority Data

Sep. 30, 2014 (JP) ..... 2014-200670
Sep. 30, 2014 (JP) ..... 2014-200671

(51) Int. Cl.
*G03G 15/16* (2006.01)
*G03G 15/00* (2006.01)

(52) U.S. Cl.
CPC ..... *G03G 15/161* (2013.01); *G03G 15/657* (2013.01)

(58) Field of Classification Search
CPC ..... G03G 15/2028; G03G 2215/2009; G03G 15/657; G03G 15/206; G03G 15/6573; G03G 2215/2038; G03G 15/1605; G03G 15/2053; G03G 15/234; G03G 15/5029; G03G 15/6564; G03G 21/1685; G03G 21/1695
See application file for complete search history.

(56) References Cited

U.S. PATENT DOCUMENTS

| | | | | |
|---|---|---|---|---|
| 7,113,734 | B2 | 9/2006 | Deguchi et al. | |
| 7,539,446 | B2 | 5/2009 | Deguchi | |
| 7,539,447 | B2 | 5/2009 | Hattori et al. | |
| 7,539,448 | B2 | 5/2009 | Miwa et al. | |
| 7,542,709 | B2 | 6/2009 | Uehara et al. | |
| 8,761,645 | B2 | 6/2014 | Deguchi et al. | |
| 2004/0218953 | A1* | 11/2004 | Gross | G03G 15/657 399/400 |
| 2009/0226199 | A1* | 9/2009 | Miyake | G03G 15/2028 399/68 |
| 2011/0206388 | A1* | 8/2011 | Sasaoka | G03G 15/2085 399/21 |

FOREIGN PATENT DOCUMENTS

| | | | |
|---|---|---|---|
| JP | H06-130825 | A | 5/1994 |
| JP | 2005-128482 | A | 5/2005 |
| JP | 2008-026810 | A | 2/2008 |
| JP | 2012-203227 | A | 10/2012 |

* cited by examiner

*Primary Examiner* — Roy Y Yi
(74) *Attorney, Agent, or Firm* — Studebaker & Brackett PC

(57) ABSTRACT

An image forming apparatus includes a transferring member and a guiding part. The transferring member is configured to form a transferring nip with an image carrier and to transfer a toner image from the image carrier to a sheet at the transferring nip. The guiding part has an upper guiding member and a lower guiding member which are disposed oppositely to both faces of the sheet in a vertical direction along a sheet conveying path toward the transferring nip. The lower guiding member has a movable lower guiding plate and a plurality of elastic members. The movable lower guiding plate is made of a thin elastic material. The plurality of elastic members are disposed along a sheet width direction crossing the sheet conveying direction and supports the movable lower guiding plate to be displaceable in a direction apart from the image carrier.

18 Claims, 11 Drawing Sheets

IMAGE FORMING APPARATUS

INCORPORATION BY REFERENCE

This application is based on and claims the benefit of priorities from Japanese Patent application No. 2014-200670 filed on Sep. 30, 2014 and Japanese Patent application No. 2014-200671 filed on Sep. 30, 2014, the entire contents of which are incorporated herein by reference.

BACKGROUND

The present disclosure relates to an image forming apparatus provided with a transferring device which transfers a toner image formed on an image carrier to a sheet.

In an image forming apparatus, such as a copying machine, a printer or a multifunction peripheral, a toner image formed on an image carrier is transferred to a sheet by a transferring device. In the transferring device, the sheet is guided along a guide to a transferring nip formed between the image carrier and a transferring member, and a transferring bias is applied to the transferring member to transfer the toner image to the sheet.

In order to prevent toner scattering due to pre-transfer or an image failure due to abnormal electric power discharge, the sheet is guided by the guide so as to come into contact with the image carrier as close as possible before the transferring bias is applied. However, if a sheet with a large thickness, such as a postcard, is guided by a fixed guide set suitably for a sheet of plain paper, since a load applied to the sheet from the guide is increased due to the thickness or hardness of the sheet, a sheet conveying speed may become slow and thereby a magnification changes or an image failure such as a dot blank may occur.

In order to prevent occurring of such an image failure caused by the fixed guide, there is an image forming apparatus having a rigid guide which is turnably provided such that one end is elastically biased in the direction of the image carrier. Also, there is an image forming apparatus having a guide supported such that one end on the side of the image carrier is deflected. In addition, there is an image forming apparatus having a flexible guide and a buffering member which is formed on the lower face of the flexible guide so as to protrude in a direction of the image carrier over the flexible guide. Further, there is an image forming apparatus having a flexible guide which is swingable in the direction of the image carrier, in which the guide is prevented from swinging toward an opposite side to the image carrier by a protrusion part.

However, in the case of the turnable rigid guide of which one end is elastically biased in the direction of the image carrier, it is difficult to adjust a biasing force with respect to a sheet which is different in thickness, width and rigidity. For example, if the rigid guide is set with respect to the image carrier as close as possible so as to be suitable for a sheet of plane paper, a conveying load applied on a sheet of postcard increases and thus an image failure, such as a dot blank, on the postcard cannot be restricted. In order to restrict such an image failure, it is necessary to attach an expensive low friction member, resulting in higher costs. Also, in a case of the guide of which one end on the side of the image carrier is deflected, a horizontal strip, character blurring or the like easily occur due to vibration generated when the rear end of the sheet is spaced away from the guide. In addition, in a case of the guide provided with the buffering member, since a friction between the buffering member and the sheet occurs, the back face of the sheet may be soiled or abrasion of the buffering member may occur. Further, in a case where the guide is prevented from swinging on the opposite side to the image carrier, since a height at which the rear end of the sheet is spaced from the guide varies depending on rigidity of the sheet, an image failure easily occurs at the rear end of the sheet.

SUMMARY

In accordance with an embodiment of the present disclosure, an image forming apparatus includes a transferring member and a guiding part. The transferring member is configured to form a transferring nip with an image carrier and to transfer a toner image from the image carrier to a sheet at the transferring nip. The guiding part has an upper guiding member and a lower guiding member which are disposed oppositely to both faces of the sheet in a vertical direction along a sheet conveying path toward the transferring nip. The lower guiding member has a movable lower guiding plate and a plurality of elastic members. The movable lower guiding plate is made of a thin elastic material. The plurality of elastic members are disposed along a sheet width direction crossing the sheet conveying direction and supports the movable lower guiding plate to be displaceable in a direction apart from the image carrier The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, an image forming apparatus according to an embodiment of the present disclosure will be described.

Figure 1:
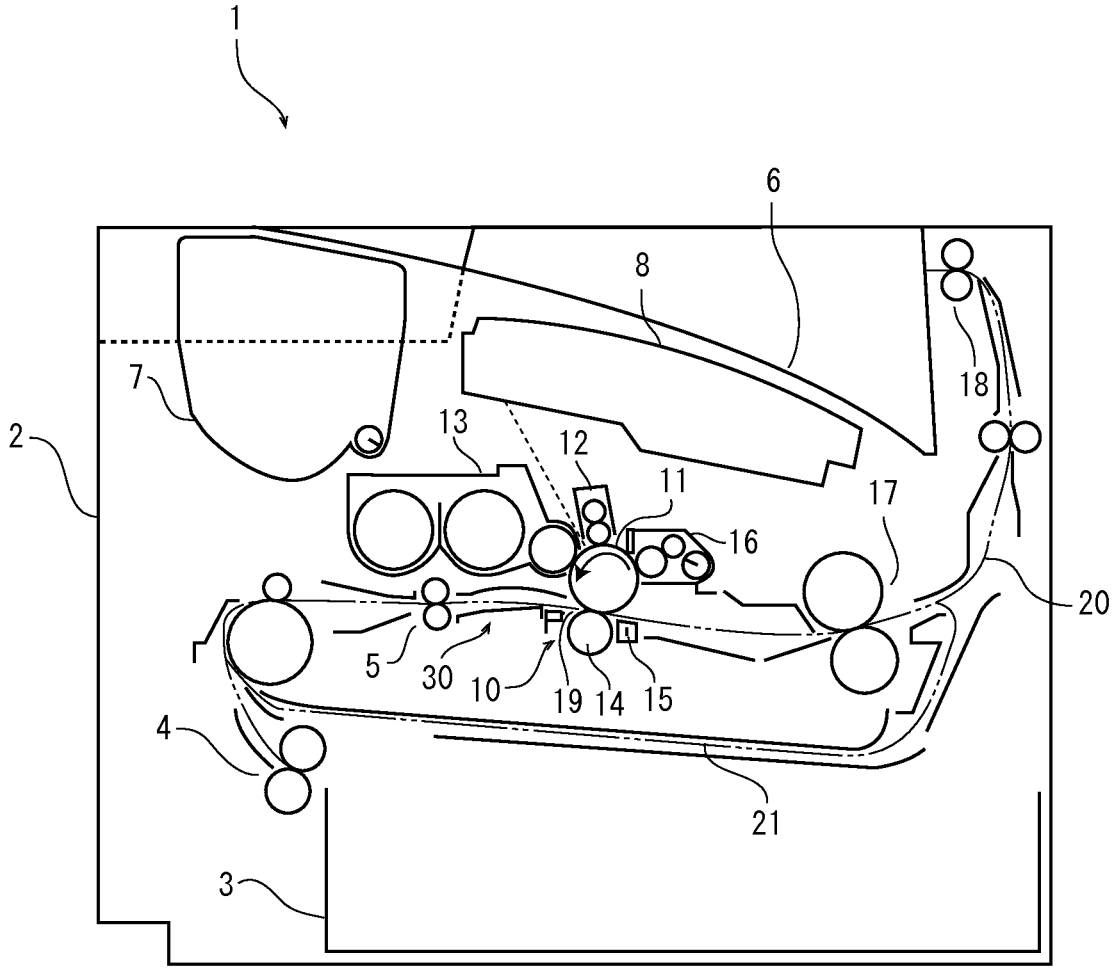
FIG. 1 is a schematic view showing an outline of a printer according to an embodiment of the present disclosure.

First, with reference to FIG. 1, a main structure of an entirety of a printer 1 (an image forming apparatus) will be described. FIG. 1 is a schematic view showing an outline of the printer according to the embodiment of the present disclosure. In the following description, a near side of FIG. 1 shows a front side of the printer 1 and left and right directions is defined as viewed from the front side of the printer 1.

The printer 1 includes a box-like formed printer main body 2. In a lower part of the printer main body 2, a sheet feeding cartridge 3 is installed and a sheet feeding device 4 feeding a sheet from the sheet feeding cartridge 3 is provided on an upper and left side of the sheet feeding cartridge 3. On an upper and right side of the sheet feeding device 4, a resist rollers pair 5 is provided. On an upper face of the printer main body 2, an ejected sheet tray 6 is provided. In an upper part of the printer main body 2, a toner container 7 containing a toner and an exposure device 8 composed of a laser scanning unit (LSU) are provided. Below the exposure device 8, an image forming part 10 is provided.

In the image forming part 10, a photosensitive drum 11 as an image carrier is rotatably provided. Around the photosensitive drum 11, a charge device 12, a development device 13, a transferring roller 14, a static eliminator 15 and a cleaning device 16 are arranged in order along a rotating direction of the photosensitive drum 11. On the right side of the image forming part 10, a fixing device 17 is provided and a sheet ejecting part 18 facing the ejected sheet tray 6 is provided above the fixing device 17.

Inside the printer main body 2, a sheet conveying path 20 is formed so as to extend from the sheet feeding device 4 toward the sheet ejecting part 18 passing through the resist rollers pair 5, a transferring nip 19 formed between the photosensitive drum 11 and the transferring roller 14 and the fixing device 17. Along the sheet conveying path 20, a guiding part 30 configured to guide the sheet to the transferring nip 19 is formed between the resist rollers pair 5 and the transferring nip 19. The sheet conveying path 20 is branched into an inversion path 21 on the downstream side from the fixing device 17. The inversion path 21 is joined to the sheet conveying path 20 on the downstream side from the sheet feeding part 4.

Next, image forming operation of the printer 1 including such a configuration will be described. When image data from a computer or the like connected to the printer 1 is inputted to the printer 1, image forming operation is carried out as follows.

First, the surface of the photosensitive drum 11 is electrically charged by the charging device 12. Then, photographic exposure corresponding to the image data is carried out to the photosensitive drum 11 by a laser light (refer to a dot chain line P in FIG. 1) from the exposure device 8, thereby forming an electrostatic latent image on the surface of the photosensitive drum 11. By flying the toner to the electrostatic latent image from the development device 13, a toner image is formed on the surface of the photosensitive drum 11.

On the other hand, the sheet fed from the sheet feeding cartridge 3 by the sheet feeding device 4 or from a manual bypass tray (not shown) is conveyed to the transferring part 19 along the sheet conveying path 20 after matching a timing of the above-mentioned image forming operation by the resist rollers pair 5. In the transferring part 19, a transferring bias having a reverse polarity to the polarity of the toner is applied to the transferring roller 14 and the toner image on the photosensitive drum 11 is transferred onto the sheet. The sheet with the transferred toner image is separated away from the photosensitive drum 11 by the static eliminator 15 and conveyed to the downstream side in the conveying path 20. The sheet goes into the fixing device 17, and then, the toner image is fixed on the sheet in the fixing device 17. The sheet with the fixed toner image is ejected from the sheet ejecting part 18 to the ejected sheet tray 6. The toner remained on the photosensitive drum 11 is collected by the cleaning device 16.

Figure 2:
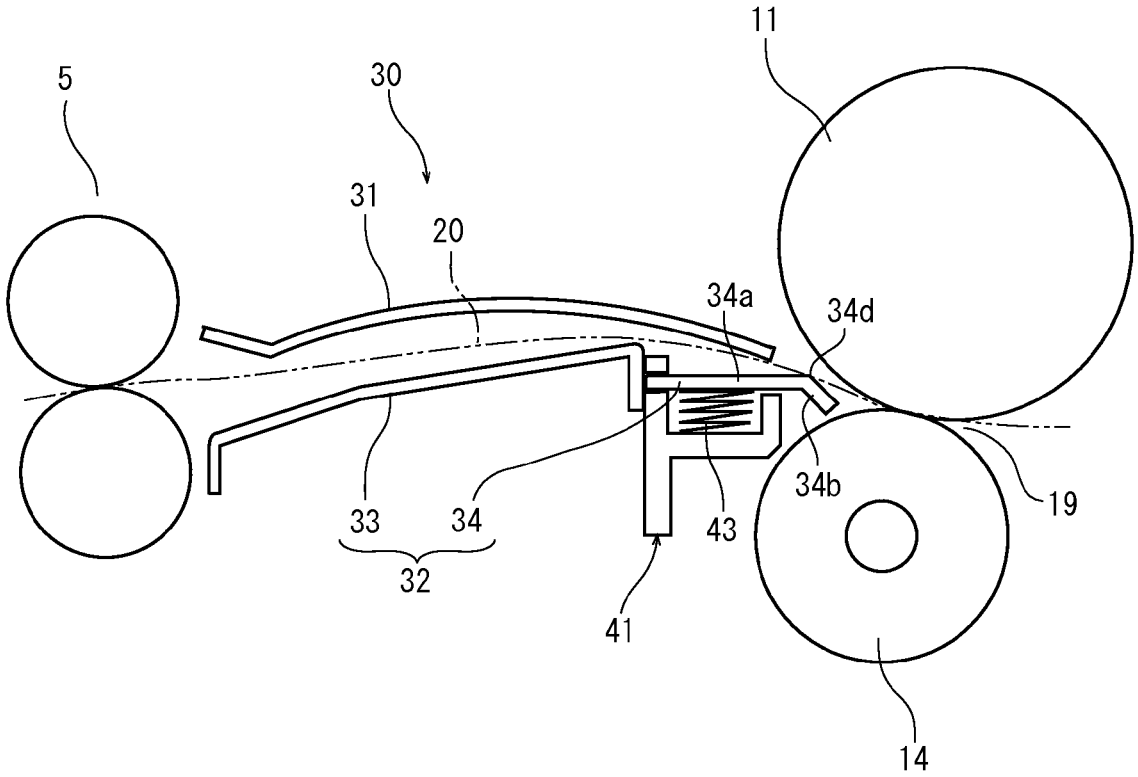
FIG. 2 is a front view showing a guiding part according to a first embodiment in the printer according to the embodiment of the present disclosure.
Figure 3A:
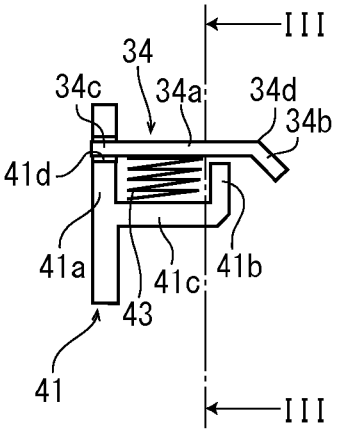
FIG. 3A is a front view showing a movable lower guiding plate of the guiding part according to the first embodiment of the present disclosure.

Next, with reference to FIG. 2 to FIG. 3B, the guiding part 30 according to a first embodiment will be described. FIG. 2 is a front view showing the guiding part; FIG. 3A is a front view showing a movable lower guiding plate; and FIG. 3B is a sectional view taken along the line III-III of FIG. 3A.

As shown in FIG. 2, the guiding part 30 includes a pre-transfer upper guiding plate 31 (an upper guiding member) and a pre-transfer lower guiding plate 32 (a lower guiding member) which are provided oppositely each other in a vertical direction. The pre-transfer upper guiding plate 31 has an upward projecting arc shape. The pre-transfer lower guiding plate 32 has a fixed lower guiding plate 33 and a movable lower guiding plate 34 which are disposed in order along the sheet conveying direction. The fixed lower guiding plate 33 is inclined upward from the resist rollers pair 5 toward the transferring nip 19. The movable lower guiding plate 34 is supported by a supporting member 41 so as to extend from below the downstream side end of the fixed lower guiding plate 33 to the transferring nip 19 over the downstream side end of the pre-transfer upper guiding plate 31 in the conveying direction.

Figure 3B:
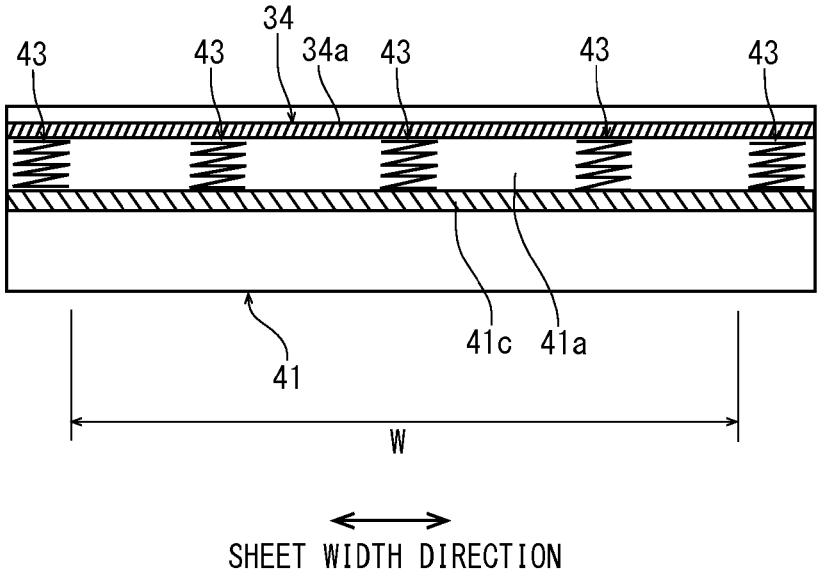
FIG. 3B is a sectional view taken along the line III-III of FIG. 3A.

As shown in FIG. 3B, the movable lower guiding plate 34, having a length slightly longer than a width of a maximum width size sheet passing region W, has a horizontal main body part 34*a* and an inclined part 34*b* inclined slightly downward from the right edge of the main body part 34*a*. At the left edge of the main body part 34*a*, a plurality of (for example, five) engagingly locking pieces 34*c* protruding leftward are formed at predetermined intervals along the sheet width direction. The movable lower guiding plate 34 is made of an elastically deformable thin material. As such a material, for example, SUS (stainless steel) with a thickness of 0.1 mm or a resin can be used.

The supporting member 41 is formed in a channel like shape of which an upper face opens, and is positioned with respect to the printer main body 2. The supporting member 41 has a left wall 41*a* and a right wall 41*b* (a displacement quantity restricting member) opposing to each other and a bottom wall 41*c*. An upper end of the left wall 41*a* is lower than the downstream side end of the fixed lower guiding plate 33. And, an upper end of the right wall 41*b* is lower than the upper end of the left wall 41*a*. In the upper portion of the left wall 41*a* higher than the right wall 41*b*, through holes 41*d* penetrating in the leftward and rightward directions and having a predetermined height are formed so as to correspond to each of the engagingly locking pieces 34*c* of the movable lower guiding plate 34.

On the bottom wall 41*c*, a plurality of (for example, five) compression coil springs 43 (elastic members) are disposed. Five of the compression coil springs 43, as shown in FIG. 3B, are disposed on both side end positions and three positions between the both side end positions on the bottom wall 41*c* in the sheet width direction at equal intervals. Incidentally, a method of supporting the compression coil springs 43 on the bottom wall 41*c* is not limited in particular, and tightening by screw or adhesive or the like can be applied. Also, in place of the compression coil springs 43, a foamed sponge or a solid rubber may be used. Alternatively, a rectangular parallelepiped-shaped elastic member having a uniform elasticity in the vertical direction and made of a foamed sponge or a solid rubber may be used. For example, a foamed sponge extending in the sheet width direction may be adhered on the bottom wall 41*c*.

The compression coil springs 43 support the movable lower guiding plate 34 with each engagingly locking piece 34*c* of the movable lower guiding plate 34 inserted into an upper space of respective through hole 41*d* of the supporting member 41. Incidentally, the movable lower guiding plate 34 is prevented from being released from the through hole 41*d* of the supporting member 41, by bending the tip end of the engagingly locking piece 34*c*, for example. In a state in which the compression coil springs 43 are compressed in natural length, the movable lower guiding plate 34 is supported such that the main body part 34*a* extends horizontally from the left wall 41*a* of the supporting member 41 up to a slightly right side from the right wall 41*b* and the inclined part 34*b* inclines downward from the right edge of the main body part 34*a* toward the transferring nip 19. Since a gap is provided between the main body part 34*a* and the right wall 41*b* of the supporting member 41, the movable lower guiding plate 34 is movable downward until the main body part 34*a* abuts against the right wall 41*b* with the engagingly locking pieces 34*c* inserted into the through holes 41*d* and is also swingable around the engagingly locking pieces 34*c*.

In addition, as shown in FIG. 2, the movable lower guiding plate 34 is supported in a posture in which a ridgeline part 34*d* at which the main body part 34*a* and the inclined part 34*b* cross each other comes closest to the photosensitive drum 11 and the inclined part 34*b* is spaced away from the photosensitive drum 11 toward the right side. Further, even if the main body part 34*a* is displaced until it abuts against the right wall 41*b* of the supporting member 41, the movable lower guiding plate 34 is kept in the posture in which the ridgeline part 34*d* comes closest to the photosensitive drum 11 and the inclined part 34*b* is spaced away from the photosensitive drum 11 toward the right side.

Figure 4A:
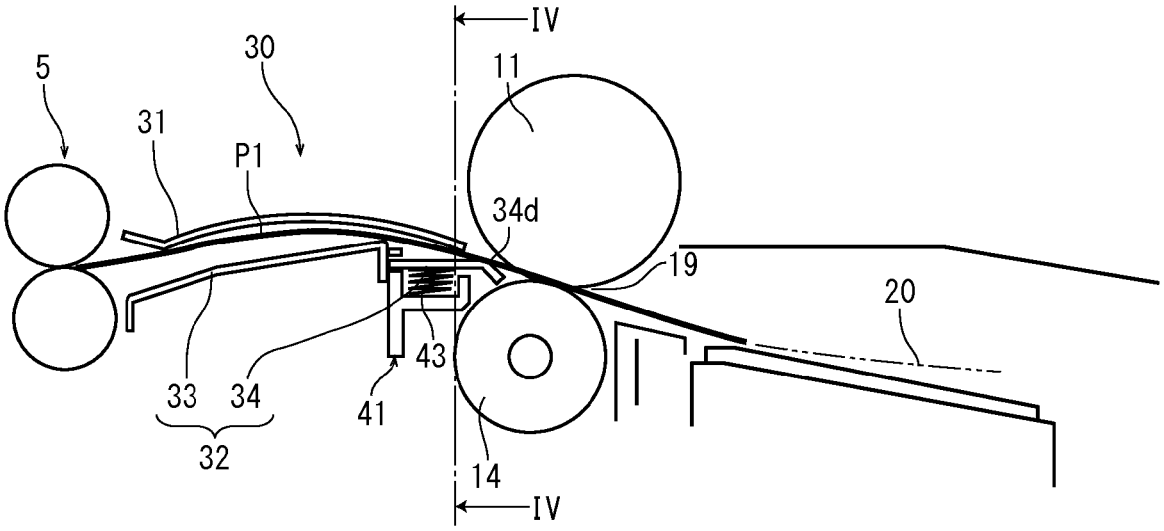
FIG. 4A is a front view showing a conveying operation of a sheet of plain paper in the guiding part according to the first embodiment of the present disclosure.
Figure 4B:
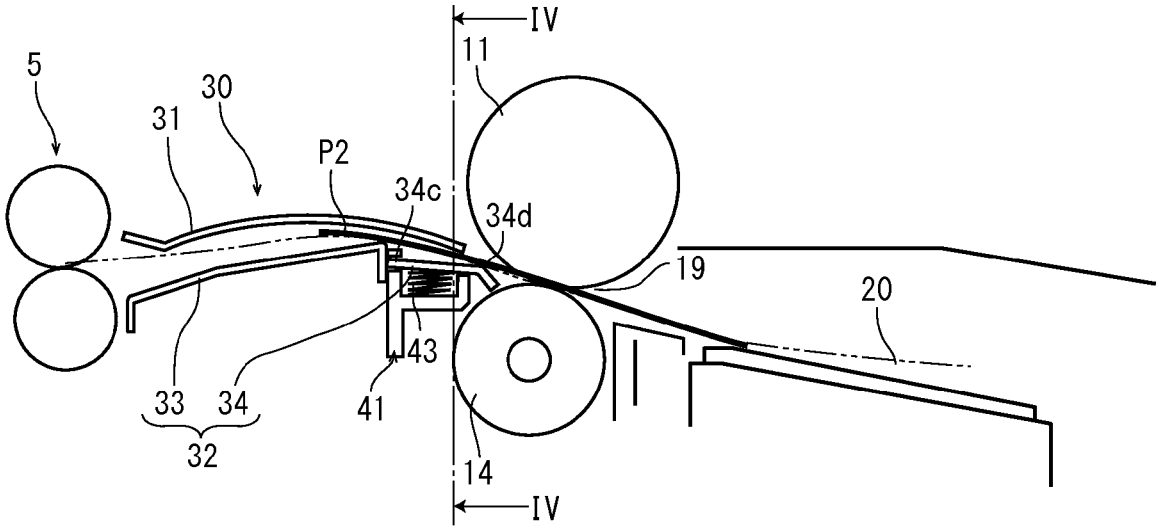
FIG. 4B is a front view showing a conveying operation of a sheet of postcard in the guiding part according to the first embodiment of the present disclosure.
Figure 5A:
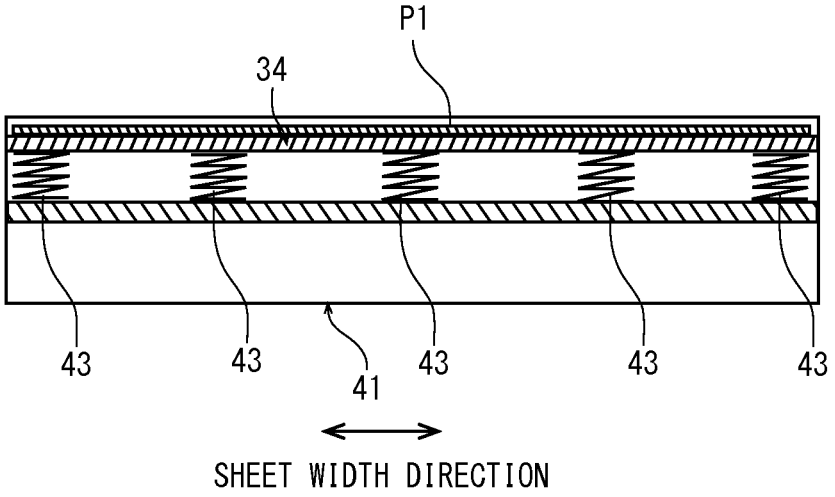
FIG. 5A is a sectional view taken along the line IV-IV of FIG. 4A.
Figure 5B:
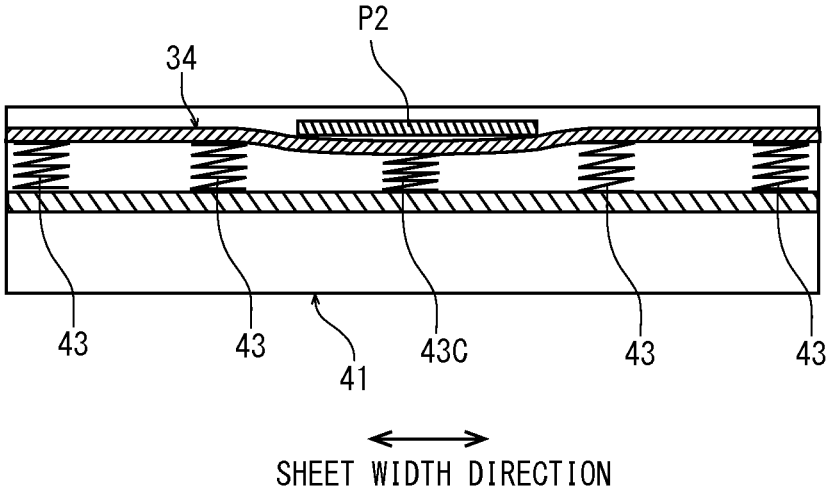
FIG. 5B is a sectional view taken along the line IV-IV of FIG. 4B.
Figure 6A:
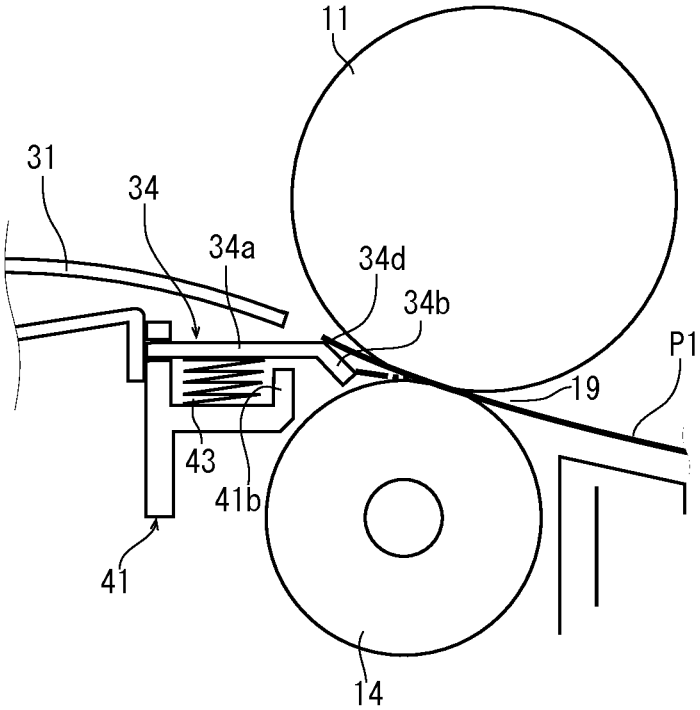
FIG. 6A is a front view showing the guiding part, when a rear end of the sheet of plain paper is spaced away from the guiding plate, according to the first embodiment of the present disclosure.
Figure 6B:
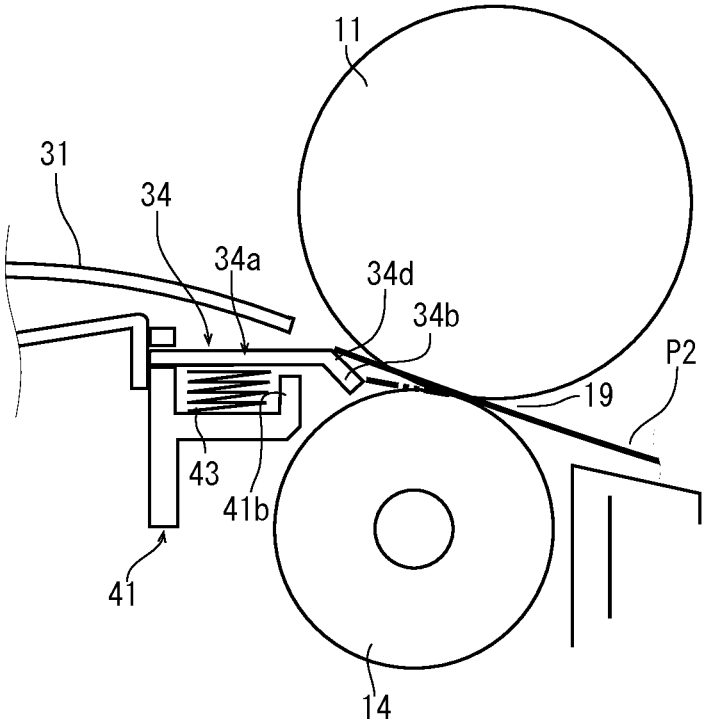
FIG. 6B is a front view showing the guiding part, when a rear end of the sheet of postcard is spaced away from the guiding plate, according to the first embodiment of the present disclosure.

With reference to FIG. 4A to FIG. 6B, an operation for conveying the sheet along the guiding part 30 having the construction mentioned above will be described. FIG. 4A is a front view showing the conveying operation of a sheet of plain paper; FIG. 4B is a front view showing the conveying operation of a sheet of postcard; FIG. 5A is a sectional view taken along the line IV-IV of FIG. 4A; FIG. 5B is a sectional view taken along the line IV-IV of FIG. 4B; FIG. 6A is a front view showing the guiding part when a rear end of the sheet of plain paper is spaced away from the guiding plate; and FIG. 6B is a front view showing the guiding part when a rear end of the sheet of postcard is spaced away from the guiding plate.

As shown in FIG. 4A, in a case where a sheet P1 of A4 size plain paper is conveyed, the sheet P1 of plain paper passes through above the movable lower guiding plate 34 from the fixed lower guiding plate 33, hits against the ridgeline part 34*d* of the movable lower guiding plate 34, hits against the surface of the photosensitive drum 11 and then is conveyed to the transferring nip 19. Since the sheet P1 of plain paper is light in weight and is small in thickness, as shown in FIG. 5A, the movable lower guiding plate 34 is hardly displaced. Also, when the rear end of the sheet P1 of plain paper is spaced away from the movable lower guiding plate 34, as shown in FIG. 6A, the rear end of the sheet P1 of plain paper is guided so as to be gradually spaced away from the photosensitive drum 11 along the inclined part 34*b* of the movable lower guiding plate 34 (refer to the double-dotted chain line).

On the other hand, in a case where a sheet P2 of postcard is conveyed as well, as shown in FIG. 4B, the sheet P2 of postcard passes through above the movable lower guiding plate 34 from the fixed lower guiding plate 33, hits against the ridgeline part 34*d* of the movable lower guiding plate 34 and then is conveyed to the transferring nip 19. However, since the sheet P2 of postcard is high in rigidity and is large in thickness, the ridgeline part 34*d* is pressed downward by the sheet P2 of postcard. Then, as shown in FIG. 5B, the compression coil spring 43C disposed within a passing region of the sheet P2 of postcard is compressed more than the compression coil springs 43C disposed in the other region, and therefore the movable lower guiding plate 34 deforms downward. At this juncture, depending on the thickness of the sheet P2 of postcard, the movable lower guiding plate 34 deforms downward until the main body part 34*a* abuts against the right wall 41*b* of the supporting member 41. At the same time, the movable guiding plate 34 swings around the engagingly locking pieces 34*c* such that the inclined part 34*b* is inclined downward. Afterwards, when the rear end of the sheet P2 of postcard is spaced away from the movable lower guiding plate 34, the movable lower guiding plate 34 is biased upward by the compression coil spring 43; and however, as shown in FIG. 6B, the rear end of the sheet P2 of postcard is guided along the inclined part 34*b* of the movable lower guiding plate 34 so as to be gradually spaced away from the photosensitive drum 11 (refer to the double-dotted chain line). In addition, after the rear end of the sheet P2 of postcard has passed through the ridgeline part 34*d* of the movable lower guiding plate 34, the movable lower guiding plate 34 reverts into a normal position or an almost normal position.

As has been described above, in the guiding part 30 according to the first embodiment, a load acting on the movable lower guiding plate 34 that is elastically deformable is dispersedly supported by the plurality of compression coil springs 43 dispersedly arranged along the sheet width direction at the transferring nip 19. Accordingly, depending on the thickness or rigidity of the sheet to be conveyed, the movable lower guiding plate 34 is partially displaced in a direction apart from the photosensitive drum 11.

Namely, in the case of a sheet of plain paper with a small thickness and a low rigidity, since the sheet is conveyed to the transferring nip 19 around the surface of the photosensitive drum 11 with the movable lower guiding plate 34 hardly displaced, an image failure such as toner scattering, transfer peeling or a white dot due to pre-discharge before the transferring or can be restricted. On the other hand, in the case of a sheet of specific small size cardboard, such as a postcard, having a large thickness and a high rigidity, since the sheet passing region of the movable lower guiding plate 34 is displaced downward, it becomes possible to pass the sheet through the transferring nip 19 without applying an excessive load on the sheet. Accordingly, a magnification change or a dot blank due to the conveying load can be prevented. Incidentally, the specific small size cardboard includes a greeting card or an envelope of a small size, and is not limited to the postcard.

Incidentally, in a case where the movable lower guiding plate 34 may be made of a non-elastically deformable rigid material, if the movable lower guiding plate 34 is supported so as to be inclined suitably for the specific small size cardboard, a full size cardboard cannot be conveyed to the transferring nip 19 in an appropriate state because an angle of inclination of the movable lower guiding plate 34 becomes large.

In addition, in the present embodiment, since the movable lower guiding plate 34 is supported by the plurality of compression coil springs 43, the load acting on the movable lower guiding plate 34 is finely dispersedly supported and thus it becomes possible to displace the movable lower guiding plate 34 finely along the sheet width direction depending on the width of a sheet. Accordingly, an image failure on the sheet having a small width and a large thickness, such as a postcard, can be prevented. Incidentally, since the compression coil springs 43 are disposed at the both side end positions and at least one position between the both side end positions of the movable lower guiding plate 34, the movable lower guiding plate 34 can be displaced depending on the width of the sheet.

Further, in the present embodiment, when the rear end of the sheet is spaced away from the movable lower guiding plate 34, the rear end is guided along the inclined part 34*b* from the ridgeline part 34*d* of the movable lower guiding plate 34 in the direction apart from the photosensitive drum 11. Therefore, vibration generated when the sheet is spaced away from the movable lower guiding plate 34 can be restricted and thus an occurrence of the horizontal strip, toner scattering, character blurring or the like can be prevented.

Furthermore, in the present embodiment, since a downward displacement of the movable lower guiding plate 34 can be restricted by the right wall 41*b* of the supporting member 41, the movable lower guiding plate 34 can be prevented from being displaced downward more than necessary and then mistakenly coming into contact with the transferring roller 14. Still furthermore, when the cardboard such as a postcard is conveyed, since an excessive release (excessive displacement more than necessary) of the movable lower guiding plate 34 is prevented, toner scattering caused by such excessive release can be prevented and therefore transferability in cardboard can be ensured.

Figure 7A:
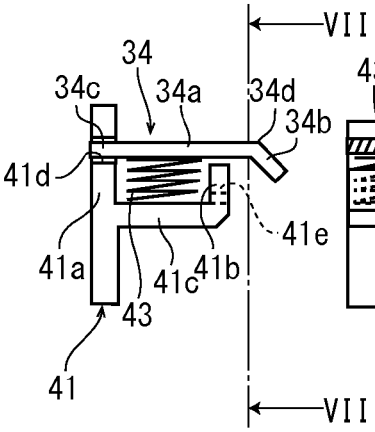
FIG. 7A is a front view showing a first modification example of the guiding part according to the first embodiment of the present disclosure.
Figure 7B:
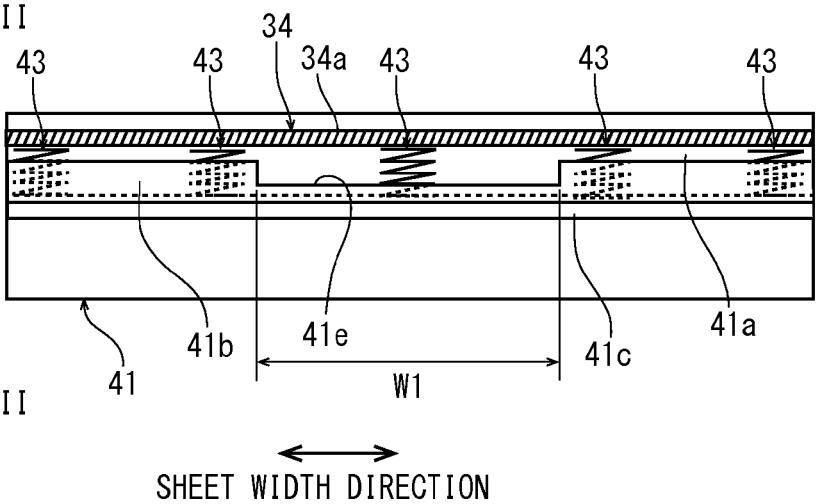
FIG. 7B is a sectional view taken along the line VII-VII of FIG. 7A.

Furthermore, in the present embodiment, as shown in FIGS. 7A and 7B, the right wall 41*b* of the supporting member 41 may be formed with a notch 41*e* having a predetermined depth from the upper edge so as to correspond to a passing region W1 of the specific small size sheet, such as a postcard, (hereinafter, conveniently referred to as a postcard passing region W1). By forming such a notch 41*e*, in the postcard passing region W1, the displaceable quantity of the movable lower guiding plate 34 becomes large.

In a case of a thick sheet having a small length and a narrow width, such as a postcard, there is an interval at which the sheet is conveyed by a conveying force of only the transferring roller 14. In such a case, a conveying speed at the interval is easily decreased by a load applied to the sheet from the guiding plate. Thus, by increasing the displaceable quantity of the movable lower guiding plate 34 in the postcard passing region W1, the load applied to the sheet from the movable lower guiding plate 34 is reduced and therefore the decreasing of the conveying speed is prevented. Accordingly, an image failure such as a magnification change or a dot blank can be prevented.

Incidentally, the supporting member 41 may not be formed with the right wall 41*b* at a position corresponding to the postcard passing region W1. Even in this case, since the displaceable quantity of the movable lower guiding plate 34 is increased at the postcard passing region W1, an image failure such as a magnification change or a dot blank can be prevented.

Figure 8A:
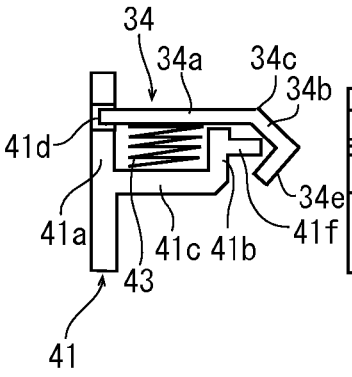
FIG. 8A is a front view showing a second modification example of the guiding part according to the first embodiment of the present disclosure.
Figure 8B:
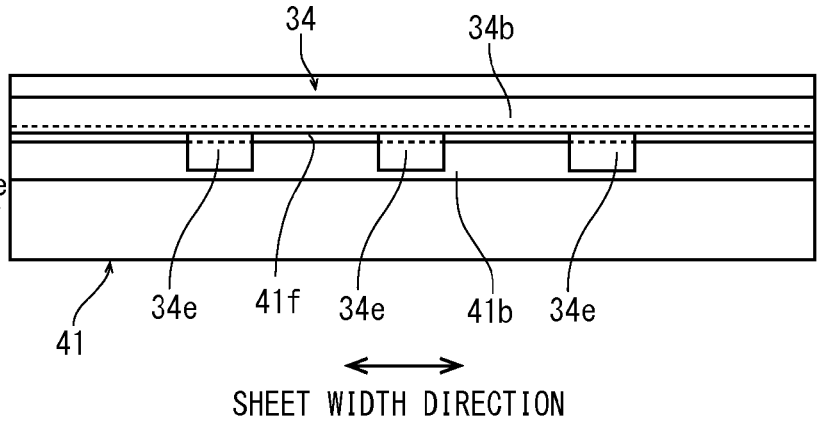
FIG. 8B is a side view showing the second modification example of the guiding part viewed from the right side, according to the first embodiment of the present disclosure.

With reference to FIG. 8A and FIG. 8B, a modification example of the movable lower guiding plate 34 of the present disclosure will be described. FIG. 8A is a front view showing the movable guiding plate and FIG. 8B is a view showing the movable guiding plate viewed from the right side.

The movable lower guiding plate 34 is formed with restricting pieces 34*e* inclined in a lower and left direction from the right edge of the inclined part 34*b*. Three of the restricting pieces 34*e*, as shown in FIG. 8B, are formed along the center portion of the right edge of the inclined part 34*b*.

The supporting member 41 is formed with a restricting part 41*f* along the sheet width direction protruding rightward from the right side face of the right wall 41*b* toward a corner between the inclined part 34*b* and the restraining pieces 34*e* of the movable lower guiding plate 34. Incidentally, the restraining part 41*f* may be partially formed along the sheet width direction.

In this example, if the movable lower guiding plate 34 may be turned upward, the restricting piece 34*e* is engagingly locked with the restricting part 41*f* of the supporting member 41 and therefore the turning of the movable lower guiding plate 34 is prevented. Therefore, for example, when handling sheet jamming occurred in the vicinity of the transferring nip 19, it is possible to prevent the movable lower guiding plate 34 from being caught by the jammed sheet and then turned upward and therefore such a sheet jamming can be easily handled.

Figure 9:
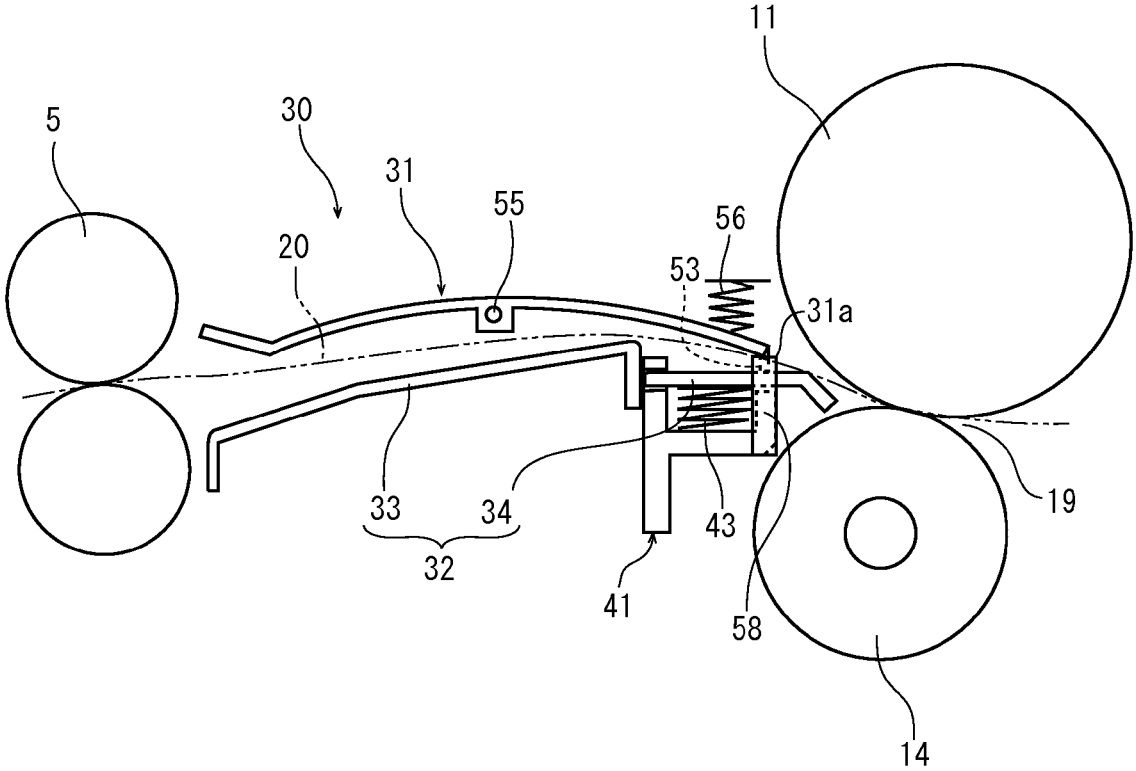
FIG. 9 is a front view showing a guiding part according to a second embodiment of the present disclosure.
Figure 10B:
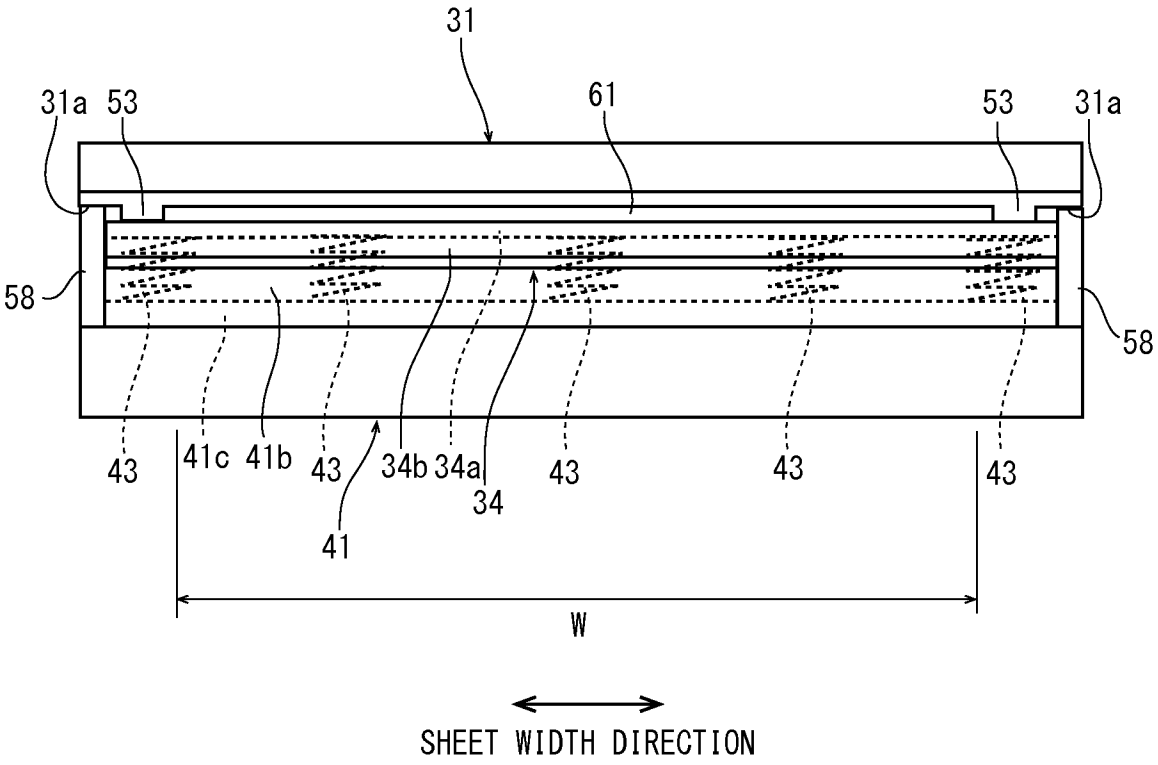
FIG. 10B is a side view showing the movable lower guiding plate viewed from the right side, according to the second embodiment of the present disclosure is seen from the right.
Figure 10A:
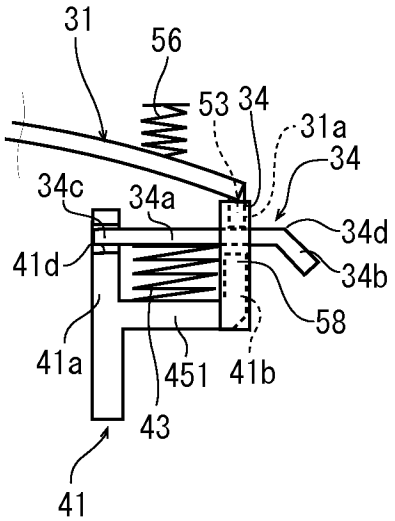
FIG. 10A is a front view showing a movable lower guiding plate of the guiding part according to the second embodiment of the present disclosure.

Next, with reference to FIGS. 9 to 11B, a guiding part 30 according to a second embodiment will be described. FIG. 9 is a front view showing the guiding part, and FIG. 10A and FIG. 10B are views showing a transfer nip side end of the guiding part 30.

As shown in FIG. 9, the guiding part 30 includes a pre-transfer upper guiding plate 31 and a pre-transfer lower guiding plate 32 which are provided so as to oppose to each other in the vertical direction. The pre-transfer lower guiding plate 32 has a fixed lower guiding plate 33 and a movable lower guiding plate 34 which are disposed in order along the sheet conveying direction.

The pre-transfer upper guiding plate 31 is a plate like member having an upward projecting arc shape. As shown in FIG. 10A and FIG. 10B, the pre-transfer upper guiding plate 31 is formed with two protrusion parts 53 bent downward at the transferring nip side end (a right end). The protrusion parts 53 having the same height, as shown in FIG. 10B, are formed inside of both side ends 31*a* in the sheet width direction and outside of the maximum width size sheet passing region W (for example, horizontal A4 size) of the printer 1.

The pre-transfer upper guiding plate 31, as shown in FIG. 9, is turnably supported by the printer main body 2 around a supporting shaft 55 extending in the sheet width direction at an almost center in the conveying path 20 between the resist rollers pair 5 and the transferring nip 19. Further, the pre-transfer upper guiding plate 31 is biased by a biasing member 56 such that the transferring nip side end (the right end) inclines downward. As the biasing member 56, a coil spring or a torsional coil spring can be used.

The fixed lower guiding plate 33 and the movable lower guiding plate 34 of the pre-transfer lower guiding plate 32 have the same configuration similar as that of the fixed lower guiding plate 33 and the movable lower guiding plate 34 in the first embodiment.

In the second embodiment, the supporting member 41 is formed with positioning parts 58 at both side ends in the sheet width direction. Each positioning part 58 is provided on the both side end faces of the right wall 41*b* in the sheet width direction protruding upward higher than the left walls 41*a*. If the transferring nip side end (the right end) of the pre-transfer upper guiding plate 31 is biased by the biasing member 56, both side ends 31*a* in the sheet width direction of the transferring nip side end of the pre-transfer upper guiding plate 31 each abut against the upper end face of the positioning part 58 and each protrusion part 53 is suspended above the right wall 41*b*.

In the guiding part 30 having the configuration mentioned above, a positioning between the pre-transfer upper guiding plate 31 and the pre-transfer lower guiding plate 32 will be described. If the transferring nip side end of the pre-transfer upper guiding plate 31 is biased by the biasing member 56 and then turns around the supporting shaft 55, the both side ends 31*a* in the sheet width direction of the transferring nip side end of the pre-transfer upper guiding plate 31 each abut against the upper end face of the positioning part 58. In this manner, the transferring side end (the right end) of the pre-transfer upper guiding plate 31 is positioned with respect to the supporting member 41.

In addition, as shown in FIG. 10A and FIG. 10B, the protrusion parts 53 formed at the transferring side end of the pre-transfer upper guiding plate 31 abuts against the upper face of the main body part 34*a* of the movable lower guiding plate 34 to press the movable lower guiding plate 34 downward. In this manner, the movable lower guiding plate 34 is positioned with respect to the pre-transfer upper guiding plate 31. Then, a gap between the pre-transfer upper guiding plate 31 and the main body part 34*a* of the movable lower guiding plate 34 is restricted to the height of the protrusion parts 53 all over the maximum width size sheet passing region W. Therefore, between the pre-transfer upper guiding plate 31 and the main body part 34*a* of the movable lower guiding plate 34, a sheet ejecting port 61 having a uniform height is formed all over the maximum width size sheet passing region W, and through this sheet ejecting port 61, the sheet is conveyed to the transferring nip 19.

Figure 11A:
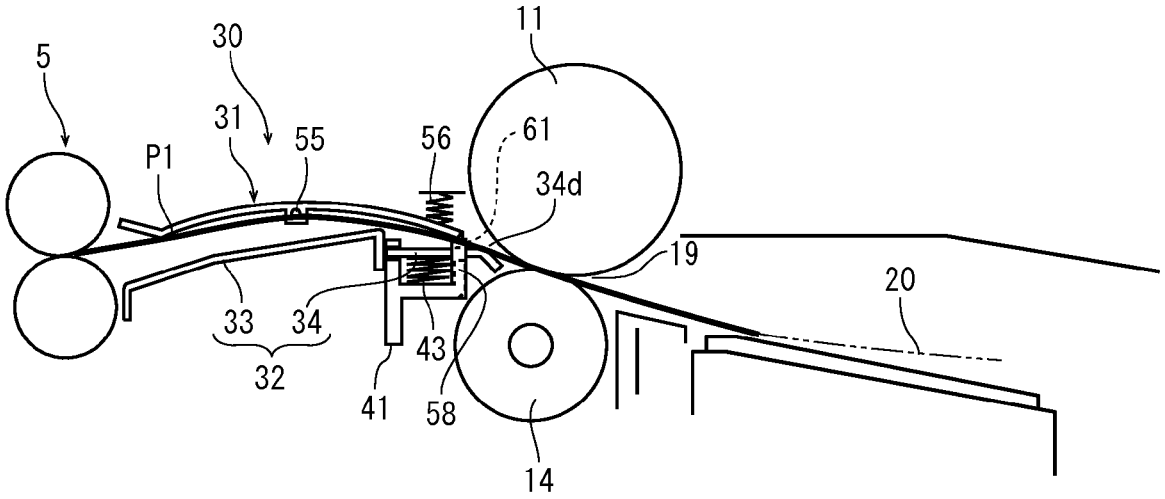
FIG. 11A is a front view showing a conveying operation of a sheet of plain paper, in the guiding part according to the second embodiment of the present disclosure.

Next, with reference to FIG. 11A and FIG. 11B, a conveying operation of the sheet by the guiding part 30 will be described. FIG. 11A is a front view showing a conveying operation of a sheet of plain paper; and FIG. 11B is a front view showing a conveying operation of a sheet of postcard.

As shown in FIG. 11A, in a case where a sheet P1 of A4 size plain paper P1 is conveyed, the sheet P1 is conveyed between the pre-transfer upper guiding plate 31 and the fixed lower guiding plate 33, and is guided toward the sheet ejecting port 61 above the movable lower guiding plate 34. Then, after passing through the sheet ejecting port 61, the sheet hits against the ridgeline part 34*d* between the main body part 34*a* and the inclined part 34*b* of the movable lower guiding plate 34, hits against the surface of the photosensitive drum 11, and is conveyed to the transferring nip 19. Since the sheet P1 of plain paper is light in weight and small in thickness, the movable lower guiding plate 34 is hardly displaced.

Figure 11B:
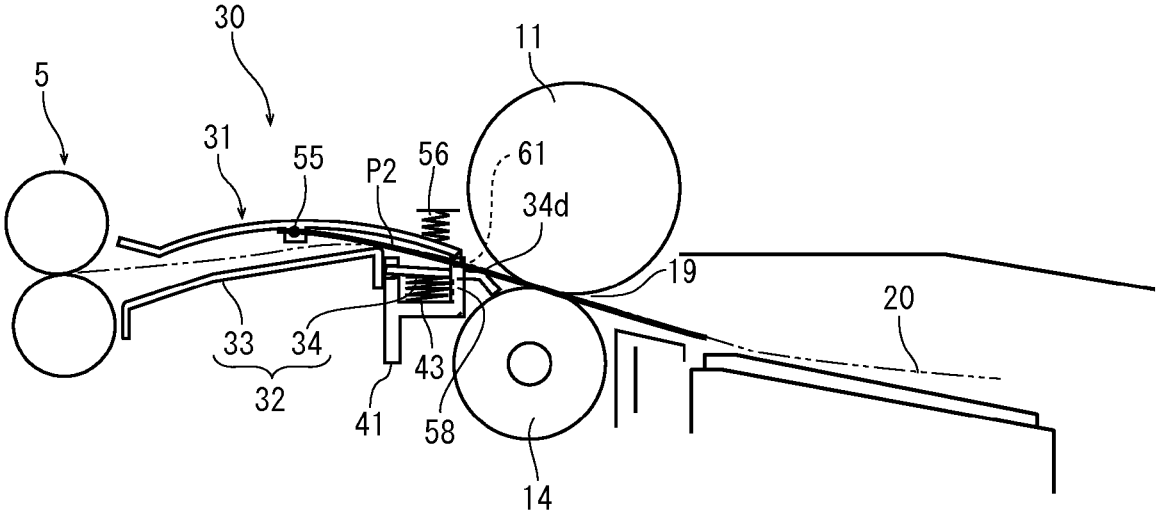
FIG. 11B is a front view showing a conveying operation of a sheet of postcard, in the guiding part according to the second embodiment of the present disclosure.

On the other hand, in a case where a sheet P2 of specific small size cardboard, such as a postcard (hereinafter, conveniently referred to as a postcard), is conveyed, as shown in FIG. 11B, the sheet P2 is also conveyed between the pre-transfer upper guiding plate 31 and the fixed lower guiding plate 33, and is guided toward the sheet ejecting port 61 above the movable lower guiding plate 34. Then, after passing through the sheet ejecting port 61, the sheet hits against the ridgeline part 34*d* of the movable lower guiding plate 34, hits against the surface of the photosensitive drum 11 and is conveyed to the transferring nip 19. At this juncture, since the sheet P2 has a high rigidity and a large thickness, the ridgeline part 34*d* of the movable lower guiding plate 34 is pressed downward by the sheet P2. Then, the compression coil spring 43 disposed in the passing region of the sheet P2 is compressed and then the movable lower guiding plate 34 deforms downward. Accordingly, the sheet P2 can be conveyed to the transferring nip 19 without being applied with a load from the movable lower guiding plate 34.

As has been described above, in the guiding part 30 according to the second embodiment, the pre-transfer upper guiding plate 31 is positioned with respect to the supporting member 41 that is positioned with respect to the printer main body 2. Further, by the protrusion parts 53 formed on the pre-transfer upper guiding plate 31, the movable lower guiding plate 34 is positioned with respect to the pre-transfer upper guiding plate 31. Therefore, from the sheet ejecting port 61 between the pre-transfer upper guiding plate 31 and the movable lower guiding plate 34, the sheet can be reliably conveyed to the transferring nip 19. Accordingly, toner scattering due to pre-transferring, an image failure due to abnormal electric power discharge or the like can be reliably prevented.

Further, since the both side ends 31*a* in the sheet width direction of the transferring nip side end of the pre-transfer upper guiding plate 31 abut against the positioning parts 58 formed on the supporting member 41 and the protrusion parts 53 formed slightly inside the both side ends 31*a* press the movable lower guiding plate 34, the height of the sheet ejecting port 61 formed between the pre-transfer upper guiding plate 31 and the movable lower guiding plate 34 can be kept uniform all over the sheet width direction. Therefore, the sheet can be stably conveyed to the transferring nip 19, and toner scattering due to pretransfer or an image failure due to abnormal electric power discharge or the like can be prevented more reliably.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a transferring member configured to form a transferring nip with an image carrier and to transfer a toner image from the image carrier to a sheet at the transferring nip; and a guiding part having an upper guiding member and a lower guiding member which are disposed oppositely to both faces of the sheet in a vertical direction along a sheet conveying path toward the transferring nip, wherein the lower guiding member has:

a movable lower guiding plate made of a thin elastic material;

a plurality of elastic members disposed along a sheet width direction crossing the sheet conveying direction and supporting the movable lower guiding plate to be deformable in a direction apart from the image carrier; and a supporting member supporting, the plurality of elastic members, wherein the plurality of elastic members are disposed at the both side end positions and at least one position between the both side end positions in the sheet width direction on a bottom wall of the supporting member.

2. The image forming apparatus according to claim 1, wherein the movable lower guiding plate is deformable in the vertical direction and is turnable around an end opposite to the transferring nip.

3. The image forming apparatus according to claim 1, wherein the movable lower guiding plate has:

a main body part extending toward the image carrier along the conveying direction;

an inclined part inclined from a downstream side end in the conveying direction of the main body part in a direction apart from the image carrier; and a ridgeline part formed at which the main body part and the inclined part cross each other, wherein the movable lower guiding plate is supported by the elastic members such that the ridgeline part comes closest to the image carrier.

4. The image forming apparatus according to claim 3, wherein the movable lower guiding plate is supported by the elastic members so as to be deformable while keeping a posture in which the ridgeline part comes closest to the image carrier and the inclined part inclines in the direction apart from the image carrier.

5. The image forming apparatus according to claim 1, wherein the lower guiding member has a deformation quantity restricting member configured to restrict a deformable quantity of the movable lower guiding plate in a direction apart from the image carrier.

6. The image forming apparatus according to claim 5, wherein the deformable quantity restraining member is formed such that a maximum quantity of the movable lower guiding plate in a specific small sire cardboard passing region is larger than a maximum deformable quantity of the movable lower guiding plate in the other region.

7. The image forming apparatus according to claim 1, wherein the lower guiding member has a turning restricting part configured to restrict turning of the movable lower guiding plate.

8. The image forming apparatus according to claim 1, wherein the upper guiding member is biased such that a transferring nip side end comes close to the lower guiding member and the transferring side end is formed with a protrusion part protruding toward the movable lower guiding plate, and the supporting member is formed with a positioning part against which the transferring nip side end of the upper guiding member abuts, wherein the upper guiding member is positioned with respect to the supporting member by biasing the transferring nip side end of the upper guiding member to abut against the positioning part of the supporting member, and the movable lower guiding plate is positioned with respect to the upper guiding member by pressing the movable lower guiding plate by the protrusion part.

9. The image forming apparatus according to claim 8, wherein the positioning parts are provided on the both side ends in the sheet width direction of the supporting member so as to abut against the both side ends in the sheet width direction of the transferring nip side end of the upper guiding member, the protrusion parts are formed inside of the both side ends in the sheet width direction of the transferring nip side end of the upper guiding member, and when the both side ends in the sheet width direction of the transferring nip side end of the upper guiding member abuts against the positioning parts of the supporting member and the protrusion parts press the movable lower guiding plate, a gap of the conveying path between the upper guiding member and the movable lower guiding plate is restricted.

10. An image forming apparatus comprising:

a transferring member configured to form a transferring nip with an image carrier and to transfer a toner image from the image carrier to a sheet at the transferring nip; and a guiding part having an upper guiding member and a lower guiding member Which are disposed oppositely to both faces of the sheet in a vertical direction along a sheet conveying path toward the transferring nip, wherein the lower guiding member has:

a movable lower guiding plate made of a thin elastic material; and a plurality of elastic members disposed along a sheet width direction crossing the sheet conveying direction and supporting the movable lower guiding plate to be deformable in a direction apart from the image carrier, wherein the movable lower guiding plate has:

a main body part extending toward the image carrier along the conveying direction;

an inclined part inclined from a downstream side end in the conveying direction of the main body part in a direction apart from the image carrier; and a ridgeline part formed at which the main body part and the inclined part cross each other, wherein the movable lower guiding plate is supported by the elastic members such that the ridgeline part comes closest to the image carrier.

11. The image forming apparatus according to claim 10, wherein the movable lower guiding plate is deformable in the vertical direction and is turnable around an end opposite to the transferring nip.

12. The image forming apparatus according to claim 10, wherein the elastic members are disposed at least at one position other than both side end positions in the sheet width direction to support the movable lower guiding plate.

13. The image forming apparatus according to claim 10, wherein the movable lower guiding plate is supported by the elastic members so as to be deformable while keeping a posture in which the ridgeline part comes closest to the image carrier and the inclined part inclines in the direction apart from the image carrier.

14. The image forming apparatus according to claim 10, wherein the lower guiding member has a deformation quantity restricting member configured to restrict a deformable quantity of the movable lower guiding plate in a direction apart from the image carrier.

15. The image forming apparatus according to claim 14, wherein the deformable quantity restraining member is flamed such that a maximum deformable quantity of the movable lower guiding plate in a specific small size cardboard passing region is larger than a maximum deformable quantity of the movable lower: guiding plate in the other region.

16. The image forming apparatus according to claim 10, wherein the lower guiding member has a turning restricting part configured to restrict turning of the movable lower guiding plate.

17. The image forming apparatus according to claim 10, wherein the upper guiding member is biased such that a transferring nip side end comes close to the lower guiding member and the transferring side end is formed with a protrusion part protruding toward the movable lower guiding, plate, and the lower guiding member has a supporting member which supports the elastic members and is formed with a positioning part against which the transferring nip side end of the upper guiding member abuts, wherein the upper guiding member is positioned with respect to the supporting member by biasing the transferring nip side end of the upper guiding member to abut against the positioning part of the supporting member, and the movable lower guiding plate is positioned with respect to the upper guiding member by pressing the movable lower guiding plate b the protrusion part.

18. The image forming apparatus according to claim 17, wherein the positioning parts are provided on the both side ends in the sheet width direction of the supporting member so as to abut against the both side ends in the sheet width direction of the transferring nip side end of the upper guiding member, the protrusion parts are formed inside of the both side ends in the sheet width direction of the transferring nip side end of the upper guiding member, and when the both side ends in the sheet width direction of the transferring nip side end of the upper guiding member abuts against the positioning parts of the supporting member and the protrusion parts press the movable lower guiding plate, a gap of the conveying path between the upper guiding member and the movable lower guiding plate is restricted.

* * * * *